US006168366B1

(12) United States Patent
Horn

(10) Patent No.: US 6,168,366 B1
(45) Date of Patent: Jan. 2, 2001

(54) METHOD OF AND APPARATUS FOR MANIPULATING CIGARETTE TRAYS

(75) Inventor: Matthias Horn, Ahrensburg (DE)

(73) Assignee: Hauni Maschinenbau AG, Hamburg (DE)

( * ) Notice: Under 35 U.S.C. 154(b), the term of this patent shall be extended for 0 days.

(21) Appl. No.: 08/850,281

(22) Filed: May 5, 1997

(30) Foreign Application Priority Data

Jun. 8, 1996 (DE) ..... 196 22 995

(51) Int. Cl.[7] ..... A24C 5/352

(52) U.S. Cl. ..... 414/416; 414/403; 414/331.14; 198/465.1; 198/463.3

(58) Field of Search ..... 53/235, 236, 249, 53/252; 414/331.14, 331.17, 331.18, 416, 417, 403; 198/280, 465.1, 463.3; 131/909, 187, 108, 282, 283

(56) References Cited

U.S. PATENT DOCUMENTS

| | | | | |
|---|---|---|---|---|
| 2,596,339 | * | 5/1952 | Lufkin | 414/403 X |
| 4,449,625 | * | 5/1984 | Grieben et al. | 198/465.1 |
| 4,468,165 | * | 8/1984 | Kawasaki | 198/465.1 X |
| 4,564,329 | * | 1/1986 | Bantien | 414/403 |
| 4,867,299 | * | 9/1989 | Fukuoka et al. | 198/463.3 X |
| 5,106,254 | * | 4/1992 | Tolasch et al. | 414/403 X |
| 5,123,798 | * | 6/1992 | Glösmann et al. | 414/403 |
| 5,524,416 | * | 6/1996 | Linner | 414/416 X |
| 5,553,988 | * | 9/1996 | Horn et al. | 414/416 |
| 5,597,219 | | 1/1997 | Horn et al. . | |

FOREIGN PATENT DOCUMENTS

| | | | | |
|---|---|---|---|---|
| 1547809 | * | 6/1979 | (GB) | 414/403 |

* cited by examiner

*Primary Examiner*—Frank E. Werner
(74) *Attorney, Agent, or Firm*—Venable; George H. Spencer; Robert Kingberg

(57) ABSTRACT

Trays for temporary reception of accumulations of parallel cigarettes are being introduced into and withdrawn from open-sided containers for groups of trays. The containers are provided with partitions defining tray-receiving compartments in a predetermined distribution, and the trays are assembled into groups wherein the trays are arrayed in such a way that they can be pushed, as a unit, into an empty container whereby each tray of the array enters a discrete compartment. Analogously, a set of mobile suction-operated devices is used to simultaneously withdraw an entire group of arrayed trays from the compartments of a filled container. The introduction of groups of filled or empty trays into containers can take place at a first level, and the evacuation of groups of filled or empty trays from filled containers can take place at a different second level. The second level can receive filled trays from a tray filling unit and the first level can serve for delivery of empty trays to the tray filling unit. Containers with groups of filled trays can be transported to a cigarette packing machine and containers with empty trays can be delivered from the packing machine.

11 Claims, 3 Drawing Sheets

METHOD OF AND APPARATUS FOR MANIPULATING CIGARETTE TRAYS

BACKGROUND OF THEE INVENTION

The invention relates to improvements in methods of and in apparatus for manipulating receptacles (known as trays and hereinafter called trays for short) which serve for temporary reception and storage of accumulations of filter mouthpieces of predetermined length or plain or filter cigarettes, cigars, cigarillos, cheroots or any other rod-shaped articles of the tobacco processing industry (hereinafter called articles or cigarettes for short).

More particularly, the invention relates to improvements in methods which can be practiced by resorting to apparatus wherein trays can be introduced into or withdrawn from containers of the type designed and dimensioned to receive two or more trays, for example, to transport groups or sets of filled trays to a cigarette packing machine and/or to transport empty trays to a tray filling unit or apparatus. Containers of such type are disclosed, for example, in commonly owned U.S. Pat. No. 5,597,219 granted Jan. 28, 1997 to Matthias U Horn et al. for "Mobile receptacle for cigarette trays". The patented containers can be utilized for temporary storage of sets or groups of filled or partially filled or empty trays, for example, for the transport of sets or groups of empty trays to a tray filling unit, e.g., a unit disclosed in commonly owned U.S. Pat. No. 5,106,254 granted Apr. 21, 1992 to Gerhard Tolasch et al. for "Apparatus for filling and emptying trays for rod-shaped articles of the tobacco processing industry", or for the transport of freshly filled trays from the patented apparatus.

The introduction of empty or filled trays into, or the evacuation of empty or filled trays from, containers which can temporarily confine two or more filled or empty trays can be carried out in apparatus which are equipped with floor-mounted or other types of vehicles or conveyors (e.g., roller conveyors) for empty and/or filled containers, and with suitable means for transporting empty and/or filled trays to and/or from empty and/or filled containers. Reference may be had to commonly owned U.S. Pat. No. 5,553,988 granted Sep. 10, 1996 to Matthias Horn et al. for "Method of and apparatus for manipulating containers for cigarette trays". The arrangement can be such that containers confining a supply of empty trays (coming, e.g., from a cigarette packing machine) are relieved of empty trays at an upper level, the thus emptied containers are caused to descend to a lower level where they receive a given number of filled trays, and the thus filled containers are transported to the packing machine. Empty trays which were withdrawn from containers at the upper level are or can be transported to a tray filling unit, and freshly filled trays are or can be transported from such unit to storage or directly to the lower level for introduction into empty containers.

The disclosures of all of the above enumerated US patents are incorporated herein by reference.

Heretofore known apparatus for filling or emptying containers for cigarette trays are operated in such a way that empty or filled trays of a set or group are evacuated from a filled container individially or seriatim, i.e., one after the other, and the same holds true for the introduction of empty or filled trays into containers. This is a time-consuming operation which is highly undesirable if such apparatus are put to use in modern high-speed production lines, e.g., in production lines containing one or more cigarette makers designed to turn out up to and well in excess of 14000 rod-shaped articles per minute.

OBJECTS OF THE INVENTION

An object of the invention is to provide a simple and economical method of emptying and filling containers for groups or sets of trays which are designed for temporary storage of rod-shaped articles of the tobacco processing industry.

Another object of the invention is to provide a method which can be resorted to with particular advantage for the manipulation of cigarette trays and containers for cigarette trays in plants which are designed to turn out huge quantities of cigarettes or other rod-shaped articles of the tobacco processing industry per unit of time.

A further object of the invention is to provide a novel and improved apparatus for the practice of the above outlined method.

An additional object of the invention is to provide a relatively simple, compact and inexpensive apparatus which can fill or empty containers for sets or groups of two or more trays within a fraction of the time required to fill or empty similar containers in accordance with heretofore known proposals.

Still another object of the invention is to provide the above outlined apparatus with novel and improved means for positioning filled or empty trays prior to introduction into containers.

A further object of the invention is to provide a novel and improved combination of a cigarette processing machine (such as a packing machine for plain or filter cigarettes) and a tray filling machine with the above outlined manipulating apparatus.

Another object of the invention is to provide an apparatus which can be utilized in existing mass production lines for the making, tipping, packing and/or otherwise treating rod-shaped articles (such as cigarettes) of the tobacco processing industry.

An additional object of the invention is to provide the above outlined apparatus with novel and improved means for automatically locating empty or filled trays of a group or set in optimum positions relative to each other preparatory to introduction of such groups or sets into containers capable of accepting and maintaining in proper mutual positions a selected number of trays for cigarettes or other rod-shaped articles of the tobacco processing industry.

Still another object of the invention is to provide the above outlined apparatus with novel and improved means for transporting containers and trays relative to each other for the purposes of confining groups or sets of empty or partially filled or filled trays in the containers.

A further object of the invention is to provide the above outlined apparatus with novel and improved tray-operated means for properly arraying the trays of a group or set preparatory to the introduction of such groups or sets into an empty container.

Another object of the invention is to provide the apparatus with novel and improved means for pushing and/or pulling sets or groups of trays relative to a container.

SUMMARY OF THE INVENTION

One feature of the present invention resides in the provision of a method of manipulating trays which are designed for temporary reception or confinement of rod-shaped articles of the tobacco processing industry and are storable in containers (e.g., in upright boxes having open front sides) of the type providing room for groups or sets of trays. The method comprises the step of effecting a relative movement between a group of empty or at least partially filled trays and a container in at least one of a plurality of directions including a first dirrection to effect a simultaneous confinement of all trays of a group in the container, and a second direction to effect a simultaneous evacuation of all trays of the confined group from the container.

The containers can be of the type having a plurality of discrete tray-receiving compartments in a predetermined distribution, one compartment for each tray of a group, and the method can further comprise the step of assembling trays into a series of groups wherein the trays are arrayed for entry into discrete compartments of the container in the course of the relative movement in the first direction. The assembling step can comprise locating the arrayed trays of the groups in positions at predetermined distances from each other so that the distribution of arrayed trays in a group at least closely approximates the predetermined distribution of compartments in a container which is to confine a group of arrayed trays. Still further, the assembling step can include assembling a succession of discrete trays into a series of groups. Moreover, such assembling step can include assembling at least partially filled trays or at least substantially empty trays into the aforementioned series of groups.

Another feature of the invention resides in the provision of an apparatus for manipulating trays which are designed for temporary reception or confinement of rod-shaped articles of the tobacco processing industry and are storable in containers of the type providing room for groups of two or more trays. The improved apparatus comprises means for effecting a relative movement between a group or set of trays and a container in at least one of a plurality of directions including a first direction to effect a simultaneous confinement of all trays of the group in the container, and a second direction to effect a simultaneous evacuation of all trays of the confined group from the container.

As already mentioned above, the containers can be of the type having a plurality of tray-receiving compartments in a predetermined distribution, and the apparatus for introduction of groups of trays into or for evacuation of groups of trays from such compartments preferably further comprises means for assembling trays into a series of groups wherein the trays are arrayed for entry into discrete compartments of an empty-container in the course of the relative movement in the first direction. The means for effecting the relative movement can include means for simultaneously engaging all trays of a group of arrayed trays for movement along a predetermined path relative to a container which is to confine a group of arrayed trays or from which a group of arrayed trays is to be evacuated. Such means for effecting the relative movement can further comprise a carriage for the engaging means and means for moving the carriage along the predetermined path.

The means for engaging can comprise a plurality of pneumatic entraining elements (such as suction cups), at least one for each tray of a group. Alternatively, the means for engaging can comprise a plurality of pushers (e.g., resilient protuberances or the like), at least one for each tray of a group.

The assembling means can comprise a plurality of transporting elements (such as endless belts, bands or chains) which are arranged to support a group of trays from below, a mobile floor (such as a plate or panel) between two spaced-apart transporting elements, and means for moving the floor between an upper level in which the floor is adjacent the undersides of the trays being supported by the two transporting elements and a lower level at which the floor is spaced apart from the undersides of the trays resting on the two transporting elements. The floor can comprise or carry means for arraying the trays which are supported by the two transporting elements. Such arraying means can comprise mobile (such as pivotable or rockable) distancing elements which are engageable and displaceable by the trays of a group being advanced onto the two transporting elements. The arrangement can be such that the distancing elements are movable by the trays being advanced onto the two transporting elements. For example, each distancing element can comprise a first portion which is being depressed by a tray already supported by the two transporting elements, and a second portion which constitutes an abutment or stop for an oncoming tray while the first portion of the respective distancing element is being depressed by a tray already supported by the two transporting elements.

The distancing elements can be arranged in two rows which flank the mobile floor, and each tray which is supported by the two transporting elements can simultaneously depress the first portions of two distancing elements, one at each side of the floor.

The second portion of each distancing element can be located at a level below a plane which is defined by the two transporting elements and which is adjacent the undersides of the trays being supported by the two transporting elements.

The novel features which are considered as characteristic of the invention are set forth in particular in the appended claims. The improved manipulating apparatus itself, however, both as to its construction and the mode of assembling and utilizing the same, together with numerous additional important and advantageous features thereof, will be best understood upon perusal of the following detailed description of certain presently preferred specific embodiments with reference to the accompanying drawings.

DESCRIPTION OF PREFERRED EMBODIMENTS

Figure 1:
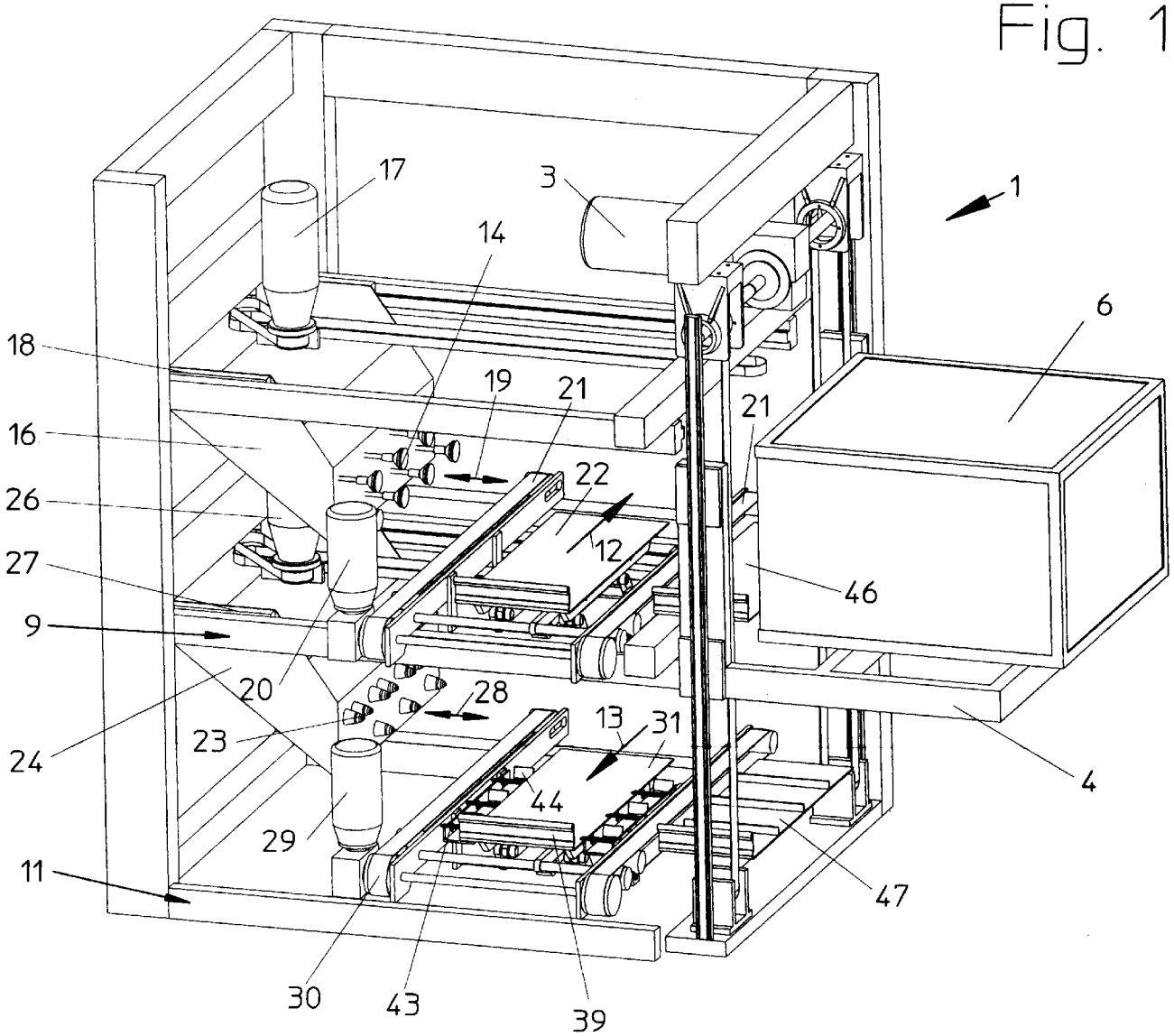
FIG. 1 is a somewhat schematic perspective view of an apparatus which embodies one form of the invention, wherein containers confining groups of empty trays can be relieved of trays at an upper level, and wherein empty containers can receive groups of filled trays at a lower level.
Figure 2:
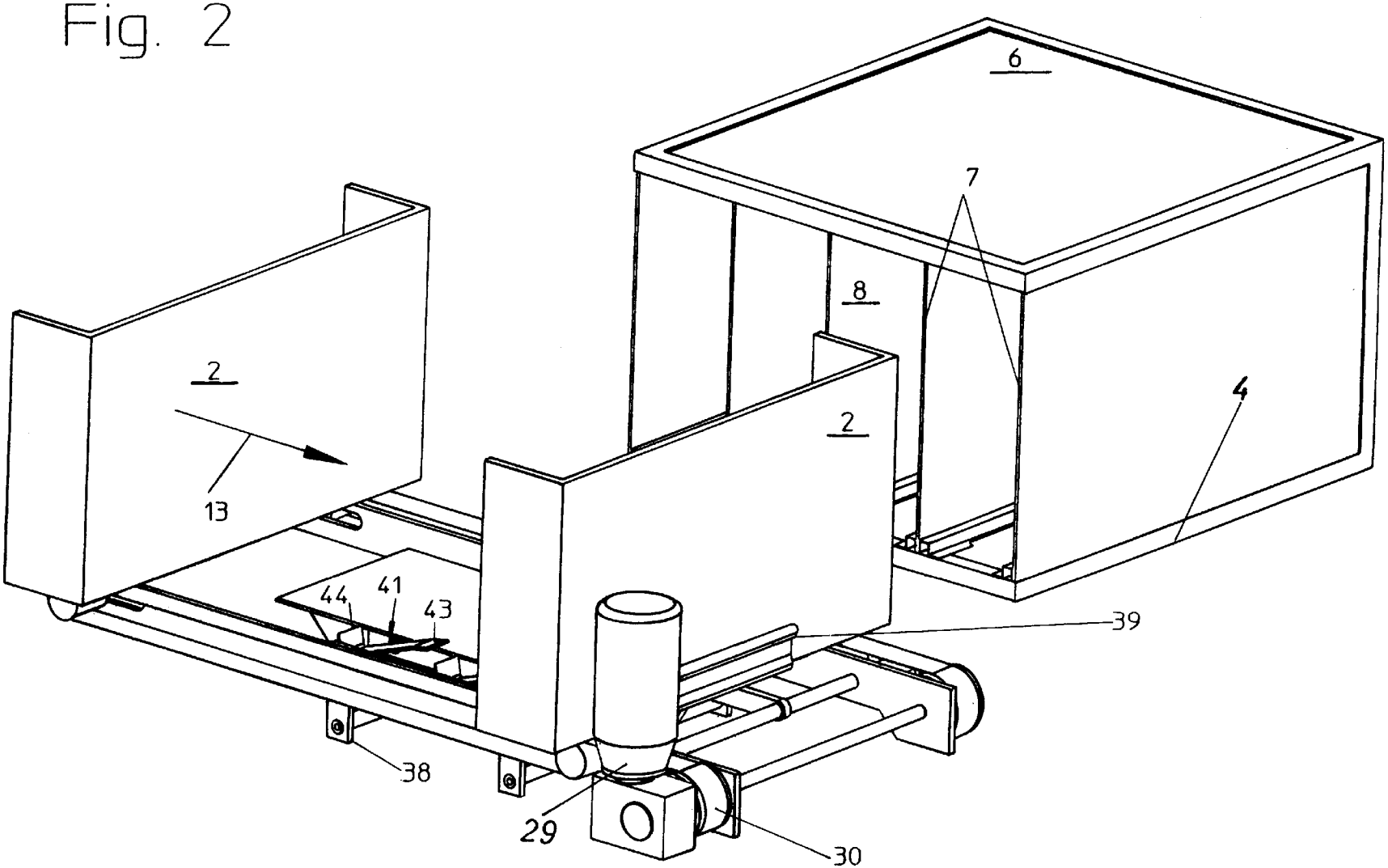
FIG. 2 is an enlarged perspective view of a detail in FIG. 1, showing the manner of arraying the trays of a group prior to introduction into an empty container.

FIG. 1 shows an apparatus which is constructed and assembled to manipulate cigarette trays 2 (FIG. 2) and containers 6. The container 6 which is shown in FIG. 2 has an open front side and internal partitions 7 establishing a series of four upright compartments 8, one for each of a group or set of properly arrayed trays 2. The containers 6 can be of the type described and shown in U.S. Pat. No. 5,597,219, i.e., each of their compartments 8 can receive a tray 2 in such a way that the contents (e.g., a plurality of parallel plain or filter cigarettes) of the properly introduced tray are at least substantially sealed from the surrounding atmosphere; this ensures that the moisture content of the confined commodities does not change appreciably, at least during a relatively short-lasting confinement in the container.

The container 6 of FIG. 1 is supported by a platform 4 which is movable up and down by a prime mover 3 (e.g., an electric motor) along upright guide rails forming part of the frame of the apparatus 1. The means for delivering containers 6 to the platform 4 (when the latter is maintained at the level shown in FIG. 1) can comprise a roller conveyor or an overhead conveyor (not shown) which delivers containers 6 confining groups of empty trays 2 from the magazine of a cigarette packing machine (not shown). If the container 6 of FIG. 1 confines a group of filled trays 2, the aforementioned conveyor can serve to deliver such containers to storage or to a consumer or processor of cigarettes, e.g., such as the aforementioned cigarette packing machine.

The platform 4 can be omitted if the conveyor which delivers containers 6 to (or receives containers from) the apparatus 1 of FIG. 1 includes a section which is movable up and down in lieu of the platform 4. Still further, it is possible to replace the platform 4, the prime mover 3 and the upright guide rails for the platform 4 with a two-storey vehicle having an upper storey or floor for one or more containers 6 which are intended to receive, temporarily store and transport empty of filled trays 2, and a lower storey or floor for one or more containers designed to receive, temporarily store and transport filled or empty trays 2.

The illustrated apparatus 1 comprises an upper storey 9 which is to receive empty trays 2 from successive containers 6 on the platform 4, and a lower storey 11 where properly arrayed groups or sets of filled trays 2 are to be introduced into successive empty containers 6 on the platform 4 (the latter is then maintained in its lower position at a level beneath the position shown in FIG. 1). A container 6 which has been emptied at the level of the upper storey 9 is lowered by the platform 4 to the level of the lower storey 11 where it receives a group of properly arrayed filled trays 2.

Empty trays 2 which are withdrawn from a container 6 at the level of the upper storey 9 can be transported (e.g., by a roller conveyor (not shown) which is designed to advance empty trays in a direction indicated by an arrow 12) to a tray filling unit of any known design, and the lower storey 11 can receive a series of discrete filled trays 2 which are delivered thereto in a direction as indicated by an arrow 13 (e.g., from the aforementioned tray filling unit such as disclosed, for example, in U.S. Pat. No. 5,106,254).

The apparatus 1 further comprises means for effecting a relative movement between a container 6 on the platform 4 and a group of empty trays 2 at the storey 9 in a direction (to the left, as viewed in FIG. 1) and for the purpose of withdrawing,,or extracting or evacuating such group from the container, or at the storey 11 in a direction (to the right, as viewed in FIG. 1) and for the purpose of introducing or inserting a group of at least partially filled and properly arrayed trays 2 into an empty container 6 on the platform 4 which is then located at the level of the storey 11, or into another container (not shown in FIG. 1) located at the level of the storey 11.

The means for effecting such relative movement at the level of the upper storey 9 comprises means for simultaneously engaging all empty trays 2 in the container 6 on the platform 4 for joint (simultaneous) movement along a predetermined (horizontal) path defined by guide means 18. The means for simultaneously engaging comprises a plurality of pneumatic entraining elements 14 each of which can constitute or include one or more simple suction cups. For example, each empty tray 2 in the container 6 on the platform 4 in the position of FIG. 1 can be engaged and entrained by two discrete suction cups 14. Other (e.g., mechanical or magnetic) means can be utilized with equal or similar advantage. The illustrated suction cups 14 are mounted on a common carriage or support 16 which is reciprocable by a prime mover 17 (e.g., an electric motor) along the path defined by the guide means 18 in directions indicated by a double-headed arrow 19.

The means for receiving a freshly withdrawn group of trays 2 comprises two transporting elements 21 (e.g., endless belts, bands or chains) having tray-supporting upper reaches or stretches movable in the direction of arrow 12 in response to starting of a prime mover 20 (e.g., an electric motor). Such receiving means further comprises a plate-like panel or floor 22 which is disposed between the transporting elements 21 and is movable up and down between an upper level at which its upper side abuts or is at least closely or immediately adjacent the undersides of the empty trays 2 resting on the upper reaches of the transporting elements 21, and a lower level beneath and out of contact with the trays on the transporting elements 21. The manner in which the floor 22 can be moved between its upper and lower levels or positions is the same as will be described with reference to a similar panel or floor 31 at the lower storey 11.

The means for effecting relative movements between a container 6 and successive groups of filled trays 2 at the lower storey 11 comprises a plurality of mechanical tray engaging elements in the form of pushers 23 (e.g., protuberances made at least in part of an elastically deformable material) mounted on a carriage or support 24 which is reciprocable by a suitable prime mover 26 (such as an electric motor) along an elongated straight horizontal path defined by a guide 27. The directions of movability of the carriage 24 along the guide means (e.g., rails) 27 are indicated by a double-headed arrow 28.

The apparatus 1 further comprises means for assembling filled trays 2 into groups or sets which are arrayed in such a way that the pushers 23 can simultaneously move an entire group of filled trays into an empty container 6 on the platform 4 (which is then located at the level of the lower storey 11) in such a way that each filled tray enters a discrete compartment 8. The assembling means at the lower storey 11 comprises two transporting elements (e.g., endless chains, belts or bands) 30 having tray-supporting upper reaches or stretches and being adapted to be driven by a prime mover 29 (e.g., an electric motor) in the direction indicated by the arrow 13. The assembling means further comprises the aforementioned plate-like horizontal panel or floor 31 which is located between the two transporting elements 30 and is movable up and down between an upper level (FIG. 2) at least close to the undersides of filled trays 2 on the upper reaches of the transporting elements 30, and a lower level (FIG. 1) at least slightly below the undersides of filled trays 2 on the transporting elements 30.

Figure 3:
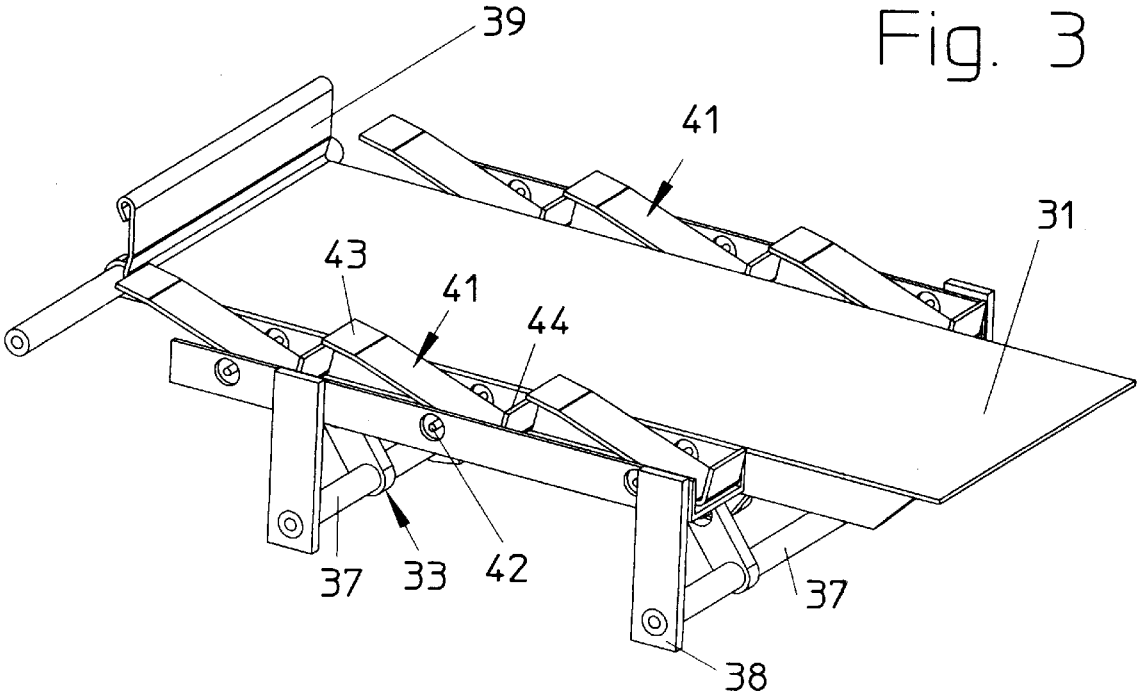
FIG. 3 is a perspective view of certain details of the means for arraying groups of trays.
Figure 4:
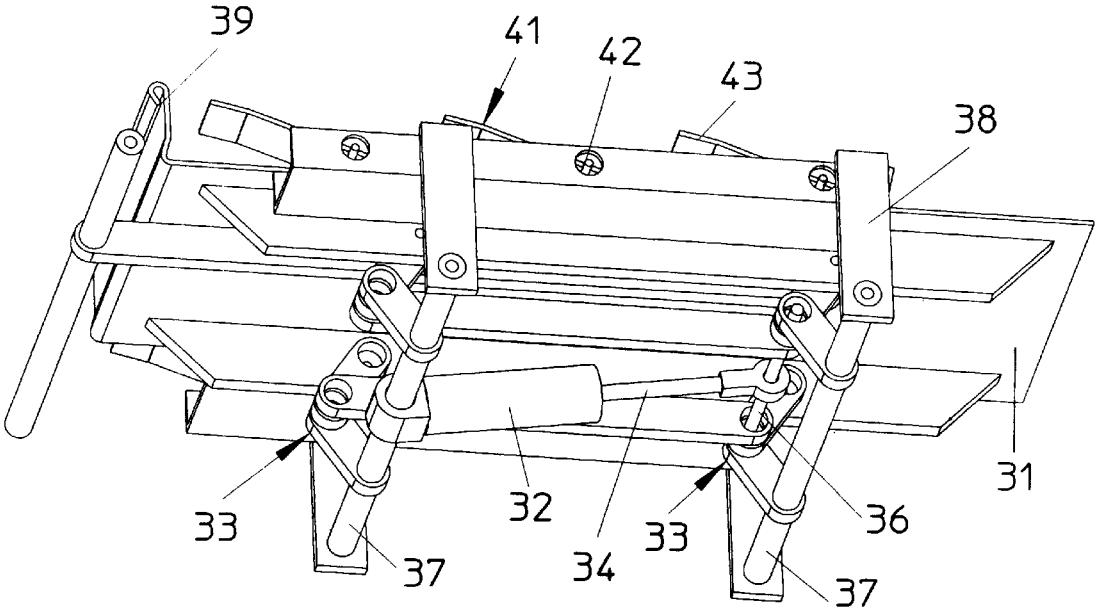
FIG. 4 illustrates the structure of FIG. 3 in another perspective view.

The means for moving the floor 31 between the upper and lower levels is shown in detail an FIGS. 3 and 4. The floor 31 carries or comprises means for arraying the filled trays 2 which are delivered seriatim (i.e., one after the other) in the direction of the arrow 13 so as to be entrained by the upper reaches of the transporting elements 30. Still further, the floor 31 carries an abutment or stop 39 which serves to arrest the foremost filled tray 2 in a predetermined position (FIG. 2) relative to the container 6 on the (lowered) platform 4 so that the thus arrested filled tray can be pushed into the registering compartment 8, i.e., into the rightmost compartment of the container 6 shown in FIG. 2). The abutment or stop 39 can be said to form part of the means for arraying filled trays 2 prior to simultaneous entry of a group or set of properly arrayed trays into an empty container 6, and such arraying means further comprises two rows of novel distancing elements 41 which flank the floor 31, i.e., one row of such distancing elements is disposed at each side of the floor 31 as seen in the direction of the arrow 13.

A first filled tray 2 which is being advanced by the upper reaches of the transporting elements 30 depresses the first or front portions 43 of the two foremost distancing elements 41 (when such tray reaches the abutment or stop 39) whereby such foremost distancing elements are caused to pivot about the horizontal axis of a shaft 42 (FIGS. 3 and 4) so that the second or rear portions 44 of the thus pivoted or rocked foremost distancing elements 41 rise above the upper side of the (raised) floor 31 and are located in the path of movement of the oncoming second filled tray 2 of a group of four filled trays to be assembled on the transporting elements 30 for simultaneous advancement into an empty container 6 by the pushers 23.

FIGS. 3 and 4 illustrate that each row comprises three distancing elements 41 because the illustrated container 6 has four compartments 8 and the foremost tray 2 of a group of four filled trays on the transporting elements 30 is arrested by the abutment or stop 39. The thickness of the second portion 44 of each distancing element 41 can slightly exceed the thickness of a partition 7.

When the floor 31 is moved to the lower level (away from the undersides of an arrayed group or set of filled trays 2 on the upper reaches of the transporting elements 30), at least the second portions 44 of (or the entire) distancing elements 41 are located beneath the trays. This ensures that the distancing elements 41 cannot interfere with simultaneous entry of an entire group of properly arrayed or positioned filled trays 2 into the respective compartments 8 of an empty container 6 when the prime mover 26 is started to move the carriage 24 and its pushers 23 in a direction to the right, as viewed in FIG. 1, i.e., toward the empty container 6 on the platform 4 (which latter is then located at the level of the lower storey 11).

The construction of the upper floor 22 and of its distancing elements is or can be the same as that of the floor 31 and the distancing elements 41 shown in FIGS. 3 and 4. The floor 22 and its distancing elements are put to use if the apparatus 1 of FIG. 1 is operated in such a way that groups or sets of properly arrayed empty or filled trays are to be introduced into empty containers 6 at the level of the upper storey 9. The suction cups 14 then serve as pushers or are replaced by suitable pushers, e.g., by components identical with or similar to those shown in FIG. 1, as at 23.

The means for moving the floor 31 between its upper and lower levels comprises a fluid-operated cylinder 32 having a reciprocable piston rod 34 which can rock a crosshead 36 about the axis of one of several horizontal shafts 37 mounted in a frame 38 which movably supports the floor 31. The connection between the crosshead 36 and the floor 31 comprises two toggle mechanisms 33 (or analogous linkages) which can raise or lower the floor 31 in response to appropriate axial displacements of the piston rod 34.

FIG. 1 further shows a stationary sheet metal bottom panel 46 which guides a group of empty trays 2 from below during extraction (by the suction cups 14) from a container 6 and during advancement onto the upper reaches of the transporting elements 21. A similar stationary sheet metal bottom panel 47 is provided to guide arrays of four filled trays 2 each on their way from the upper reaches of the transporting elements 30 into an empty container 6 at the level of the lower storey 11.

The operation of the apparatus 1 of FIG. 1 is as follows:

The container 6 of FIG. 1 is assumed to confine an arrayed group of four empty trays 2, one in each of the upright compartments 8. The floor 22 is maintained at its upper level so that it can properly support the empty trays 2 from below during extraction from the container 6 and during advancement toward and onto the upper reaches of the transporting elements 21 (and more specifically toward and onto the left-hand transporting element 21). Such advancement is effected by the suction cups 14 which are moved by their common carriage 16 in a direction to the left, i.e., toward the retracted positions which are shown in FIG. 1. The floor 21 is thereupon lowered, and the prime mover 20 is started in order to cause the transporting elements 21 to advance the group of empty trays in a single file and sideways in the direction indicated by the arrow 12, e.g., toward or into a tray filling unit.

The platform 4 can be lowered (by the prime mover 3) to the level of the lower storey 11 as soon as the group of four empty trays 2 is fully withdrawn from the respective compartments 8. The empty container 6 is then ready to receive a group of filled trays 2 which are preferably (or which can be) maintained in positions of readiness on the upper reaches of the transporting units 30, i.e., the assembly of an array of four filled trays 2 on the transporting elements 30 can be completed not later than when the platform 4 completes its descent to the level of the lower storey 11.

The assembly of a properly arrayed group or set of four filled trays 2 on the transporting elements 30 takes place in a stepwise fashion, i.e., discrete filled trays 2 are advanced in the direction of the arrow 13 seriatim (one after the other). The first or foremost filled tray 2 is caused to move all the way toward and against the abutment or stop at the forward end of the floor 31; such foremost filled tray then depresses the first portions 43 of the two foremost distancing elements 41 so that the second portions 44 of such distancing elements then move upwardly above the upper side of the (raised) floor 31 whereby the second portions 44 can arrest the oncoming second filled tray 2 at an optimum distance from the foremost tray then abutting the stop 39. The same procedure is repeated in connection with the delivery of the third and fourth filled trays 2 of a group which is to be pushed (by 23) into the adjacent empty container 6 as soon as the floor 31 and its distancing elements 41 are lowered by the cylinder 32 whereby each filled tray of such group advances over the panel 47 (which can be grooved or channeled to even more accurately guide the trays 2 on their way toward and into the container on the platform 4) and enters the respective compartment 8 of the container 6 on the (lowered) platform 4. Such container is then ready for advancement to the magazine of a packing machine, to storage or to another destination (depending upon the nature of the rod-shaped articles in the filled trays).

An important advantage of the improved method and apparatus is that the filling or emptying of containers 6 takes up a small fraction of the time which is required to introduce or withdraw discrete trays, i.e., one single tray after the other. Moreover, the trays can be readily arrayed with a degree of accuracy which invariably suffices to ensure that all trays can be simultaneously withdrawn from a filled container as well as that all trays of a properly assembled group or set can invariably enter discrete compartments of an empty container. Accumulation of successive groups of empty or filled trays for introduction into successive empty containers can begin and can take place as soon as the trays to be assembled into groups reach the improved apparatus; this also contributes to considerable savings in time and space. Additional savings are achieved in that each tray which is to be assembled into a group with one, two, three or more trays (depending upon the capacities of the containers) need not carry out any unnecessary movements, i.e., the extent of movement of a foremost tray (toward the abutment or stop 39) exceeds that of the next-following tray, and so forth.

The carriages 16 and 24 contribute to the simplicity, compactness and reliability of the apparatus 1 in that they ensure that the movements of all of the entraining elements 14 and of all of the pushers 23 are properly synchronized as well that a single prime mover (17, 26) suffices to move all of the elements 14 and all of the pushers 23.

The floors 22 and 31 perform numerous desirable, important and advantageous functions, such as guiding arrays of empty or filled trays 2 between the respective transporting elements 21, 30, raising or lowering the respective distancing elements (such as 41) between operative and inoperative positions, and properly positioning the respective distancing elements for engagement by the oncoming trays.

The provision of two rows of distancing elements (such as 41) at opposite sides of the respective floor (such as 31) is desirable and advantageous because this further enhances the likelihood of highly predictable and accurate positioning (arraying) of successive trays 2 of a group of trays to be assembled on the respective transporting elements (such as 30).

The operation of the improved apparatus can be automated to any desired extent. Furthermore, the operation of the apparatus 1 can be synchronized with that of the apparatus or machine or production line which receives empty trays from the upper level 9, with that of the machine, apparatus or production line which supplies filled trays to the lower level 11, and/or with that of the apparatus, machine or production line which fills and/or empties the trays.

The floor 22 can be relieved of distancing elements when it is not used for the assembly of groups of trays at the level of the upper storey 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating cigarette trays and, therefore, such adaptations should and are intended to be comprehended within the meaning and range of equivalence of the appended claims.

What is claimed is:

1. Apparatus for manipulating trays which are designed for temporary reception of rod-shaped articles of the tobacco processing industry and are storable in containers having a plurality of discrete tray-receiving compartments in a predetermined distribution comprising means for effecting a relative movement between a group of trays and a container in at least one of a plurality of directions including a first direction to effect a simultaneous confinement of all trays of the group in the container, and a second direction to effect a simultaneous evacuation of all trays of a confined group from the container, said means for effecting said relative movement including means for simultaneously engaging all trays of the group for movement along a predetermined path relative to the container which is to confine the group of trays or from which the group of trays is to be evacuated; and means for assembling trays into a series of groups wherein the trays are arrayed for entry into discrete compartments of the container in the course of said relative movement in said first direction, said assembling means comprising a plurality of transporting elements arranged to support the group of trays from below, a mobile floor between two of said transporting elements and means for moving said floor between an upper level in which the floor is adjacent the trays being supported by said transporting elements and a lower lever, said floor comprising means for arraying the trays which are supported by said two transporting elements.

2. The apparatus of claim 1, wherein said means for effecting said relative movement further comprises a carriage for said engaging means and means for moving said carriage along said path.

3. The apparatus of claim 1, wherein said means for engaging comprises a plurality of pneumatic entraining elements, at least one for each tray of the group.

4. The apparatus of claim 3, wherein said entraining elements include suction cups.

5. The apparatus of claim 1, wherein said means for engaging comprises a plurality of pushers, at least one for each tray of the group.

6. The apparatus of claim 1, wherein said plurality of transporting elements include endless flexible elements.

7. The apparatus of claim 1, wherein said arraying means comprises mobile distancing elements which are engageable and displaceable by the trays of the group being advanced onto said two transporting elements.

8. The apparatus of claim 1, wherein said distancing elements are movable by the trays,.being advanced onto said two transporting elements.

9. The apparatus of claim 8, wherein each of said distancing elements includes a first portion which is being depressed by a tray already supported by said two transporting elements and a second portion constituting an abutment for an oncoming tray while said first portion is being depressed by a tray already supported by said two transporting elements.

10. The apparatus of claim 9, wherein said distancing elements are arranged in two rows flanking said floor and each tray which is supported by said two transporting elements depresses the first portions of two distancing elements, one at each side of said floor.

11. The apparatus of claim 9, wherein said second portion of each of said distancing elements is located at a level below a plane defined by said two transporting elements and being adjacent the trays being supported by said two transporting elements.

* * * * *